United States Patent [19]

Murphy

[11] Patent Number: 4,545,573

[45] Date of Patent: Oct. 8, 1985

[54] SURGICAL LEG CLAMP

[75] Inventor: William J. Murphy, Saginaw, Mich.

[73] Assignee: Saginaw Automation & Machine, Inc., Saginaw, Mich.

[21] Appl. No.: 471,755

[22] Filed: Mar. 3, 1983

[51] Int. Cl.[4] ..... A61G 13/00

[52] U.S. Cl. ..... 269/328; 269/75; 269/76; 269/131

[58] Field of Search ..... 269/75, 76, 130–132, 269/328; 128/133, 134; 378/208

[56] References Cited

U.S. PATENT DOCUMENTS

| | | | |
|---|---|---|---|
| 1,516,795 | 11/1924 | Schwarting | 269/328 |
| 2,057,992 | 10/1936 | Wiruth | 311/11 |
| 2,535,559 | 12/1950 | Wolf | 269/328 |
| 3,802,692 | 4/1974 | Lipson | 269/325 |
| 4,181,297 | 1/1980 | Nichols | 269/328 |
| 4,232,681 | 11/1980 | Tulaszewski | 128/653 |
| 4,252,113 | 2/1981 | Scire | 128/134 |
| 4,252,306 | 2/1981 | Johnson et al. | 269/328 |
| 4,291,229 | 9/1981 | Patt | 250/451 |
| 4,373,709 | 2/1983 | Whitt | 269/328 |

*Primary Examiner*—Frederick R. Schmidt
*Assistant Examiner*—Judy J. Hartman
*Attorney, Agent, or Firm*—Miller, Morriss & Pappas

[57] ABSTRACT

A surgical leg clamp assembly for securing the thigh of a patient to an operating table for arthroscopy of the knee and arthroscopic and/or knee surgery. The surgical leg clamp consists of an elongate main frame which is universally adjustably secured to the side of an operating table and which is provided with an easily adjustable thigh-encircling snap-belt clamp assembly which is adapted to incrementally apply selective continuous clamping pressure to the thigh without resultant discomfort or damage thereto. The surgical leg clamp assembly is also adapted for selected snap-release and reapplication of the selected retentive pressure without the need for further readjustment of the surgical leg clamp assembly to reachieve the original clamping pressure.

3 Claims, 7 Drawing Figures

SURGICAL LEG CLAMP

This invention relates to a surgical leg clamp assembly for securing the thigh of a patient to an operating table for arthroscopy of the knee and arthroscopic and/or knee surgery. The surgical leg clamp consists of a frame which is universally adjustably secured to the side of an operating table and which is provided with an easily adjustable thigh-encircling snap-belt clamp assembly which is adapted to incrementally apply selective continuous clamping pressure to the thigh without resultant discomfort or damage thereto. The surgical leg clamp assembly is also adapted for selected snap-release and reapplication of the selected retentive pressure without the need for further readjustment of the surgical leg clamp assembly to reachieve the original clamping pressure.

The leg restraining or clamp devices of the prior known art which are intended for use in arthroscopic surgery or knee surgery utilize rigid clamping components which are cumbersome and difficult to install and utilize. Such prior art clamp devices are not easily and incrementally adjustable so as to apply selectively constant clamping pressure to the thigh without resultant discomfort or damage to the thigh of the patient. Further, none of the clamp devices of the prior art are configured to have the capability of incrementally applying and maintaining a predetermined clamping pressure against a thigh without resultant discomfort or damage thereto. Further, none of the surgical leg clamp devices of the prior cited art have the capability of providing for selected snap-release and reapplication of retentive pressure without the need for further readjustment of the surgical leg clamp to reachieve the original clamping pressure. Further, none of the prior art clamp devices have a universal adjustment capability in relation to the surface of the operating table upon which they are mounted so as to achieve maximum comfort for the patient and maximum, examining and operating convenience in use for the surgeon and his assistants.

A need has therefore existed for a surgical leg clamp provided with a clamping assembly which is easily installed so as to encircleably engage the thigh and which is easily adjustable to incrementally apply a constant encircling retentive predetermined pressure to the thigh without discomfort or damage thereto.

A further need has existed for a surgical leg clamp which, after original selective clamped retentive engagement around a thigh, can be selectively snap released therefrom and snap reengaged therearound to automatically achieve the prior selected clamping pressure without the need to readjust the surgical leg clamp to achieve such original retentive clamping pressure.

A still further need has existed for a surgical leg clamp which is adjustably mounted upon an operating table so as to be substantially universally adjustable with respect to the surface of the operating table so as to achieve maximum comfort for the patient and maximum examining and operating convenience in use for the surgeon and his assistants.

It is therefore an object of this invention to provide a surgical leg clamp having an easily incrementally adjustable thigh-encircling snap-belt clamp assembly which can be easily installed around a thigh and which can be easily adjusted so as to incrementally apply and retain encircling selected retentive pressure thereagainst and without discomfort or damage thereto.

Another object of this invention is to provide a surgical leg clamp assembly which is fully adjustable and which can be selectively mounted upon an operating table so as to be substantially universally adjustable with respect to the surface thereof.

Yet another object of this invention is to provide a surgical leg clamp assembly which is adapted to secure a thigh of a patient to an operating table and to incrementally apply and retain retentive pressure thereagainst without resultant discomfort or damage to the thigh.

A still further object of this invention is to provide a surgical leg clamp which, after original selected clamped retentive engagement around a thigh, can be selectively snap released therefrom and snap reengaged therearound without the need to readjust the surgical leg clamp to the original selected retentive clamping pressure.

Other objects and advantages found in the construction of the invention will be apparent from a consideration of the following specification in connection with the appended claims and the accompanying drawings.

IN THE DRAWINGS

DESCRIPTION OF PREFERRED EMBODIMENT

Figure 1:
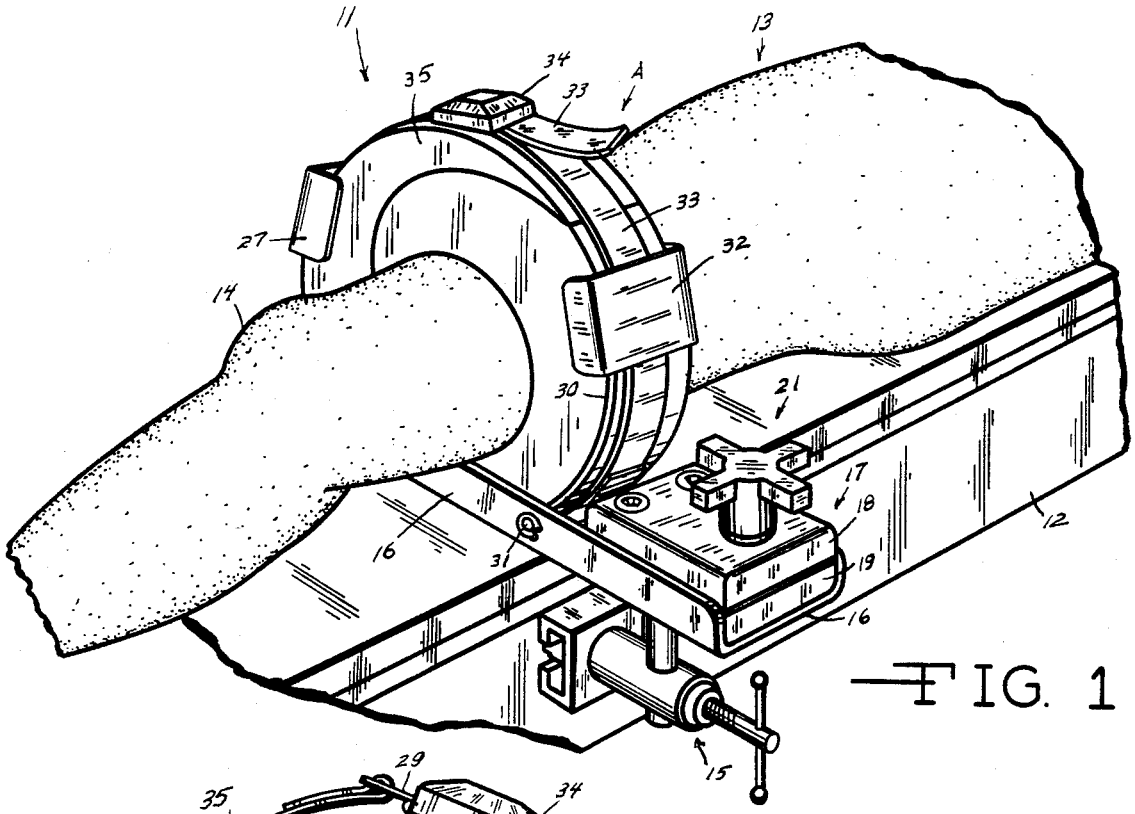
FIG. 1 is a schematic perspective view of the surgical leg clamp assembly in its universally adjustable operative use position on an operating table in clamped retentive engagement with the thigh of a patient.

As shown in the perspective view of the FIG. 1, the surgical leg clamp assembly 11 is universally adjustably mounted upon an examining and/or operating table 12 so as to secure the thigh 13 of a patient thereto. The surgical leg clamp assembly 11 is selectively positioned on the operating table 12 so as to clampably engage the thigh 13 several inches above the knee 14.

Figure 2:
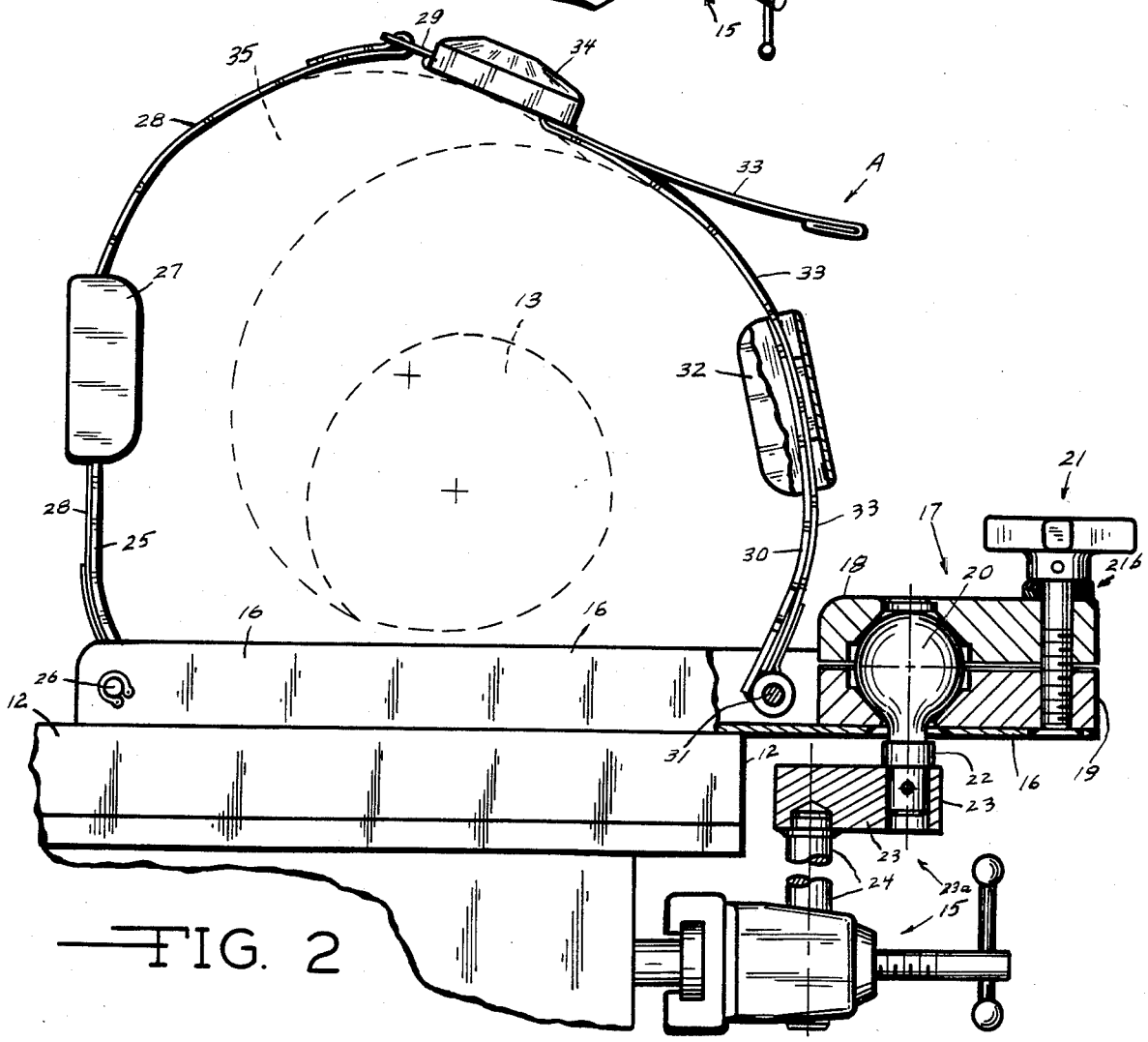
FIG. 2 is a schematic cross-sectional side view of the surgical leg clamp assembly in its operative use position and showing the adjustable ball-joint mounting clamp assembly.
Figure 3:
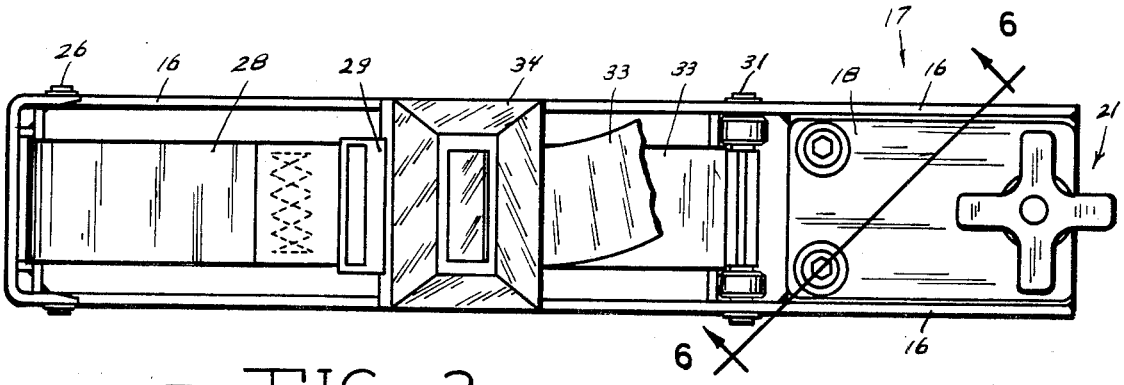
FIG. 3 is a top view of the surgical leg clamp assembly showing the snap belt and buckle assembly and the elongate universally adjustable frame upon which it is mounted.
Figure 4:
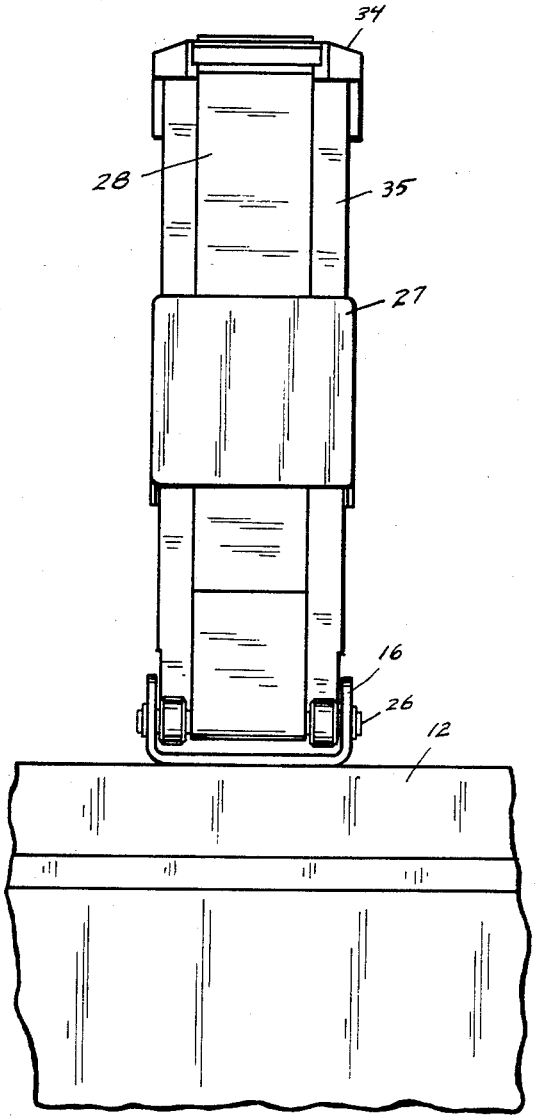
FIG. 4 is a left end view of the surgical leg clamp assembly in its operative use position and showing the pivotally mounted left snap retainer belt and guide arm assembly.
Figure 5:
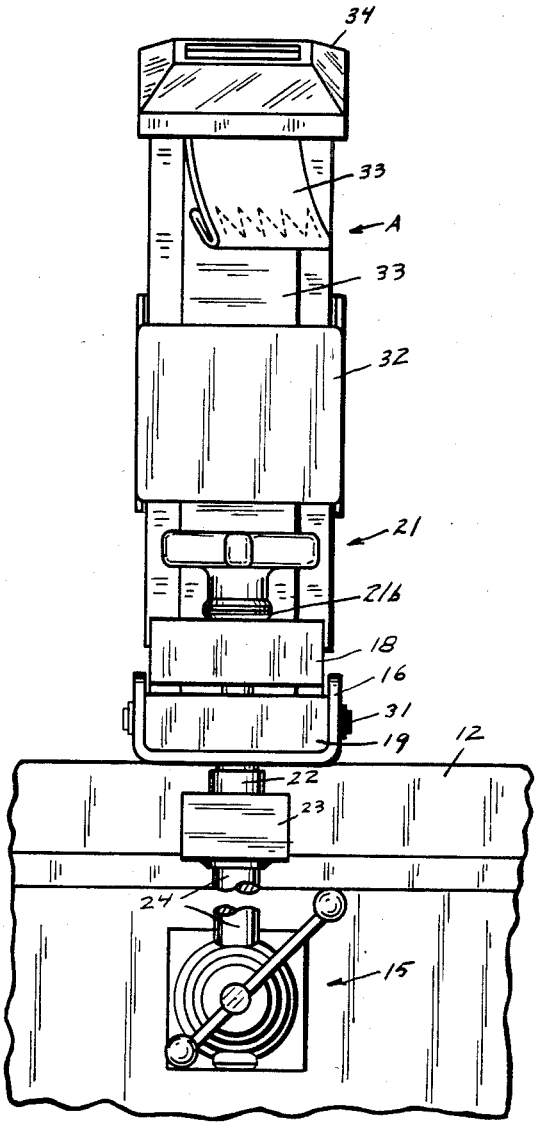
FIG. 5 is a right end view of the surgical leg clamp assembly in its operative use position and showing the pivotally mounted right snap retainer belt and guide arm assembly and the adjustable ball-joint mounting clamp assembly in association with the surgical leg clamp frame.

As shown generally in the drawings and more specifically in FIGS. 1, 2 and 5, the surgical leg clamp assembly 11 is secured to the operating table 12 by use of a standard post clamp assembly 15. The surgical leg clamp assembly 11 is comprised of an elongate stainless steel main frame 16 having a generally U-shaped cross-sectional configuration. The main frame 16 is configured to support a universal ball-joint clamp-block assembly 17 at the right end thereof proximate to the edge of the operating table 12.

Figure 6:
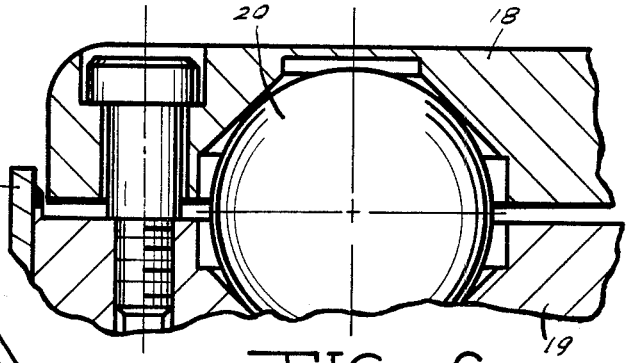
FIG. 6 is a schematic partial cross-sectional view of the universally adjustable ball-joint mounting clamp assembly taken on line 6—6 of FIG. 3.
Figure 7:
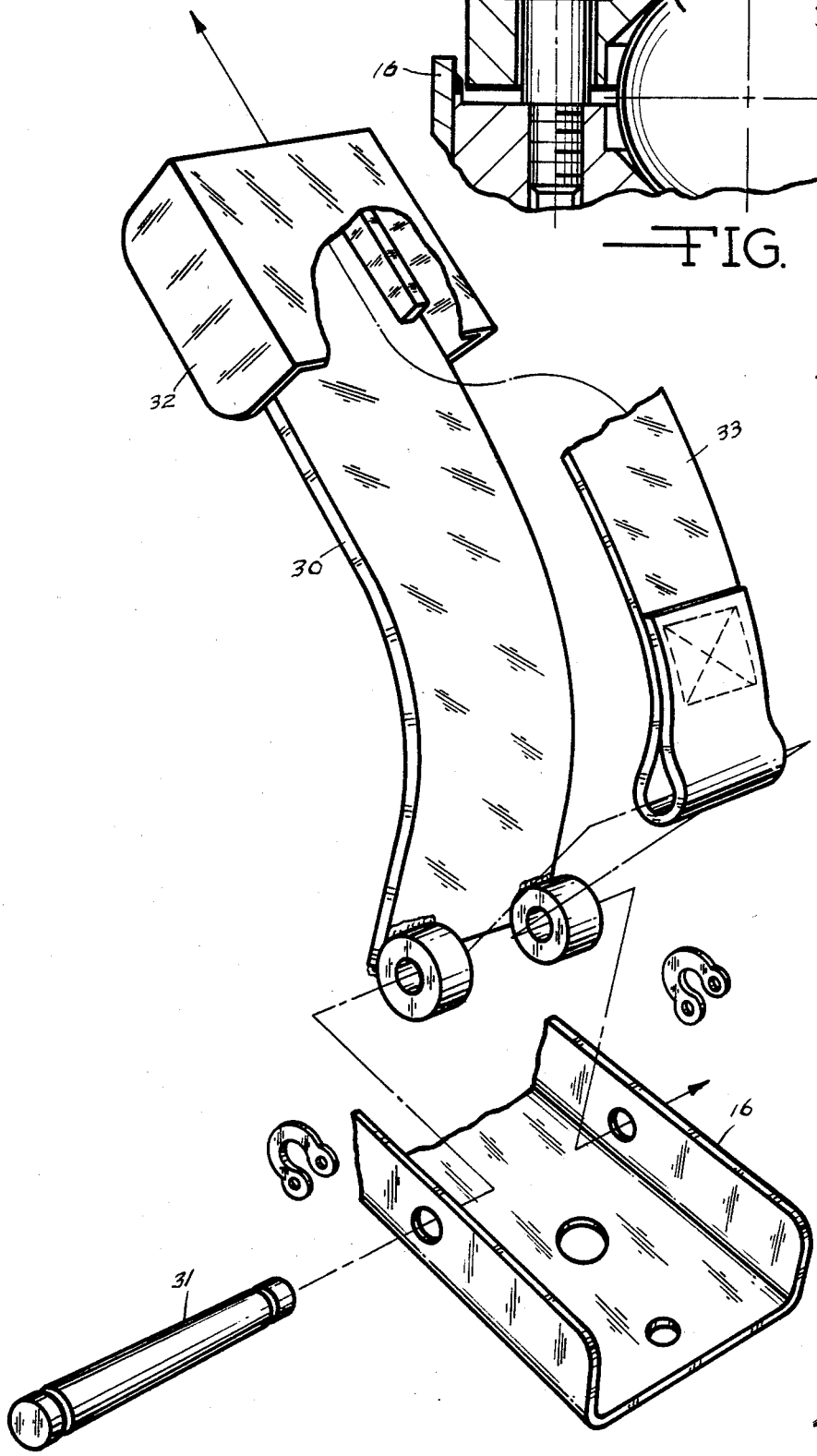
FIG. 7 is an exploded schematic partial perspective view of the right snap retainer belt and guide arm assembly showing the belt and the guide arm anchor support means in pivotal engagement with the surgical leg clamp main frame.

As specifically shown in FIGS. 2 and 6, the universal ball-joint clamp block assembly 17 is comprised of an upper clamp block 18 and a lower clamp block 19 which adjustably engage a ball member 20 therebetween. An adjustment knob assembly 21 is provided in threadable engagement with the upper and lower clamp blocks 18 and 19, respectively, which selectively moves the blocks 18 and 19 into selective clamp locked engagement with the ball member 20.

The adjustment knob assembly 21 includes self-aligning washers **21*b* which are adapted for joining the companion clamping lock members 18 and 19, respectively, which may be in misalignment. The universal ball-joint clamp-block assembly 17 provides for substantially universal selective adjustment of the elongate main frame 16 of the surgical leg clamp assembly in relation to the upper surface of the operating table 12 upon which it is mounted. Thus, the main frame is selectively adjusted in a horizontal arc across the operating table surface so as to achieve maximum comfort for the patient and maximum convenience in use for the surgeon and his assistants. Further, the ball-joint clamp-block assembly 17 permits selective limited rotational tilting of the elongate main frame 16 about its longitudinal axis to accommodate the relative positioning of the thigh 13 thereacross so as to further maximize patient comfort and to maximize convenience in use insofar as the surgeon and his assistants are concerned. Thus lockably engaged, the universal clamp-block assembly 17 secures the main frame 16** into its locked clamping position after the thigh of the patient has been secured thereto, as described hereinafter.

The ball-joint member 20 has a downwardly extending stem member 22 which is fixedly attached to a horizontally oriented crank adjustor bar 23. A fixed offset clamp post 24 spaced-apart from the stem member 22 extends downwardly from the adjustor bar 23 for selective engagement with standard post clamp assembly 15. The use of the horizontal adjustor bar 23 in fixed engagement with the clamp post 24, the stem member 22 and the ball-joint 20 forms a crank assembly **23*a* which imparts a selective adjustment capability to the main frame 16 so as to provide for limited in and out selective transverse adjustment of the surgical leg clamp assembly 11 in relation to the edge of the operating table 12. Although not shown in the drawings, it is within the scope of the invention for the clamp post 24 to be in direct engagement with the ball-joint member 20 so as to eliminate the use of the crank adjustor bar 23 with a resultant elimination of the selective transverse adjustment capability of the surgical leg clamp 11** as described above.

In use, the main frame 16 of the surgical leg clamp assembly 11 extends inwardly at any desired selected angle across the surface of the operating table 12 upon which it is mounted. Thus positioned, the main frame 16 extends below the thigh which is to be secured by the surgical leg clamp assembly 11.

A snap belt left guide arm member 25 is pivotally connected to the left end of the main frame 16 by use of a pivot pin 26. The left guide arm member 25 is adapted to extend upwardly from the main frame 16 and is slightly curved inwardly so as to approximate the outer circumferential configuration of the thigh positioned in the surgical leg clamp assembly 11. A plastic insert and retainer belt left side guide member 27 having a substantially U-shaped cross-sectional configuration is provided at the upper end of the left guide arm member 25. A left retainer belt 28 is also pivotally connected to the pivot pin 26 and extends upwardly in abutting slidable engagement against the outer surface of the guide arm member 25. The left retainer belt 28 is adapted to slidably extend upwardly through a slot opening provided in the left side guide member 27. A conventional snap release buckle-engaging tongue member 29 is provided at the end of the left retainer belt 28 so as to be located approximately above a thigh positioned in the surgical leg clamp assembly 11 as shown in FIGS. 1 and 2.

A snap belt right guide arm member 30 is pivotally connected to the right or outer end of the main frame 16 by use of a pivot pin 31. The right guide arm 30 is adapted to extend upwardly from the main frame 16 and is slightly curved inwardly in spaced-apart opposed registry with the left guide arm 25 so as to be in spaced-apart bracketing relationship with the thigh 13 of a patient. A plastic insert and retainer belt right side guide member 32 is provided at the upper end of the guide arm 30. A right retainer belt 33 is adapted to slidably extend upwardly through the right side guide member 32 so as to adjustably engage and retain a conventional push button snap-release latch buckle assembly 34 approximately above the thigh 13 in aligned operative registry with the tongue member 29. Thus positioned, the snap-release latch buckle assembly 34 can selectively lockably engage the tongue member 29 so as to cooperate with the retainer belts 28 and 33, respectively, to retainably encompass a thigh 13 positioned within the surgical leg clamp assembly 11 as shown in FIGS. 1 and 2.

In use, a protective cellular plastic foam cushion member 35 is wrapped around the thigh 13 before the thigh is placed in the surgical leg clamp assembly. Thus positioned, the cushion member 35 is selectively engaged by the left guide arm 25, the left side guide member 27, the left retainer belt 28, the tongue 29, the buckle assembly 34, the right retainer belt 33, the right side guide member 32 and the right guide arm 30, respectively, as shown in FIGS. 1 and 2. It is within the scope of the invention that the thigh be directly secured by the retainer belts without the use of a cushion member if the size of the thigh so warrants.

After the thigh 13 is encircled with the soft protective cushion member 35 and is retainably encompassed as described above, the end portion A of the right retainer belt 33 is selectively incrementally tightened so as to achieve the desired and appropriate retentive pressure or tension against the thigh 13. The thigh 13 is then further secured to the table 12 by tightening the clamp block assembly 17 by actuating the adjustment knob assembly 21 and then selectively tightening the clamp post assembly 15.

As previously stated, the retainer belts 28 and 33, respectfully, can be selectively disengaged and re-engaged by actuation of the snap release buckle 34 are required during the examination and surgical procedures. Thus, the retainer belts 28 and 33, respectfully, can be re-engaged to automatically achieve the original retentive tension or pressure without time-consuming readjustment of the entire surgical leg clamp assembly.

In use, the skin preparation and draping is distal to the device. The use of this type of surgical leg clamp eliminates the fatigue and inconsistency that may occur when the thigh is held by the operating room personnel or when the leg clamp in use is cumbersome to use and does not have snap release and re-engagement capabilities and the universal adjustment and incremental tightening capabilities that are inherent in the instant invention. The assistant is thus free to control the extremity using both hands for surgical manipulation in response to instructions from the surgeon as he works.

With the thigh thus secured, a varus or valgus stress will open the joint for easy viewing of all compartments. Access to the posterior compartments is facilitated by this versatile easily adjustable surgical leg clamp. Exposure is also adequate for open knee surgery.

This surgical leg clamp can selectively produce a pressure of 250–300 mm of mercury in the secured position. Therefore, a potential tourniquet effect is possible, as desired. It should not be left in the tightened position any longer than one would leave on a pneumatic tourniquet. If necessary, the retainer belts can be snap-released and re-engaged as required.

Previous experiences in this type of surgery with use of surgical leg clamps of the prior known art have shown that the surgeon must be concerned with potential ligammentous stretching or tearing. Thus, the snap-release and quick re-engagement capability and the incremental tightening capability inherent in this surgical leg clamp assembly takes on added critical significance when viewed from the well-being of the patient as well as from the convenience in use by the surgeon and his assistants.

It is thus seen that a surgical leg clamp is provided having an elongate main thigh-support frame. The main thigh-support frame is adapted for selective adjustable mounting upon an operating table. A left guide arm is pivotally connected to the left end of the elongate main frame. The left guide arm member is adapted to extend upwardly from the main thigh-support frame along one side of a thigh positioned thereon. A left retainer belt is pivotally connected to the left end of the main thigh-support frame in operative engagement with the left guide arm. The left retainer belt is adapted to extend upwardly along the left guide arm to a point therebeyond. The left retainer belt is provided with a buckle-engaging tongue member. The tongue member is selectively positioned approximately above a thigh positioned on the main thigh-support frame. A right guide arm is pivotally connected to the right end of the main thigh-support frame. The right guide arm is adapted to extend upwardly from the main thigh-support frame in spaced-apart opposed registry with the left guide arm so as to bracket therebetween a thigh positioned on the main frame.

A right retainer belt is pivotally connected to the right end of the main thigh-support frame in operative engagement with the right guide arm. The right retainer belt is adapted to extend upwardly along the right guide arm to a point therebeyond. The right retainer belt is adjustably provided with a snap-release latch buckle assembly in aligned operative registry with the tongue member. The buckle assembly is adapted to selectively engage the tongue member so as to connect the left retainer belt and the right retainer belt around a thigh positioned on the main frame. The right retainer belt is adapted for selective incremental tightening so as to cause the left retainer belt and the right retainer belt to exert selective retentive pressure against a thigh positioned on the main frame. The snap release buckle assembly is adapted to permit selective disengagement and selective re-engagement of the left retainer belt and the right retainer belt while maintaining the original retentive pressure against the thigh upon re-engagement without the need for readjustment of the surgical leg clamp assembly.

The surgical leg clamp assembly can be selectively provided with a foam cushion member in association with said main thigh-support frame so as to selectively encompass a thigh positioned thereon. A universal ball-joint clamp block assembly is provided in association with the main thigh-support frame so as to provide selective substantially universal adjustability of the main thigh-support frame in relation to an operating table upon which it is mounted. A crank assembly is provided in association with the universal ball-joint clamp assembly so as to provide selective in and out transverse adjustment of the elongate main thigh-support frame in relation to the edge of an operating table upon which it is mounted. The universal ball-joint clamp block assembly is provided with a ball-joint member having a fixed ball-joint stem member extending downwardly therefrom to fixedly engage a horizontal crank adjustment bar. The crank adjustment bar is provided with a fixed downwardly extending clamp post spaced-apart from the ball-joint stem member. The clamp post is adapted for selective engagement with a standard post clamp assembly provided on an operating table.

In summary, a highly utilitarian surgical leg clamp assembly is provided which is adapted for securing a thigh to an operating table and which is selectively universally adjustable with respect to the operating table upon which it is mounted. The surgical leg clamp is provided with a retainer belt assembly which is adapted to selectively incrementally apply and retain retentive pressure against the thigh without resultant discomfort or damage thereto. The retainer belt assembly of the surgical leg clamp is adapted to permit selective snap disengagement of the retainer belt assembly from the thigh and selective snap re-engagement therearound so as to automatically achieve the prior selected clamping pressure around the thigh without the need to readjust the surgical leg clamp to achieve such original retentive clamping pressure.

Various other modifications of the invention may be made without departing from the principle thereof. Each of the modifications is to be considered as included in the hereinafter appended claims, unless these claims by their language expressly provide otherwise.

I claim:

1. In a surgical leg clamp, the combination comprising:

an elongate main thigh-support frame having a left end, a right end and a substantially U-shaped cross-sectional configuration, said main thigh-support frame adapted for selective adjustable mounting upon an operating table;

a universal ball joint assembly integrally mounted within one end of said elongate main thigh-support frame, said universal ball joint assembly comprising a lower clamp block mounted within said U-shaped main support frame, said lower clamp block having an upper clamp block in operative engagement thereabove, said lower clamp block and said upper clamp block adapted to operably receive a universal ball joint therebetween;

operating table clamp means adapted to clampably mount said main thigh-support frame transversely on an operating table, said clamp means having said universal ball joint extending upwardly therefrom so as to be selectively in operative engagement within said main thigh-support frame between said lower clamp block and said upper clamp block positioned on said main thigh support frame so as to impart selective universal adjustment of said main support frame about its own longitudinal axis;

adjustment knob lock means provided in threadable engagement with said main thigh-support frame, said lower clamp block and said upper clamp block so as to clampably secure said main thigh-support frame in any selected position in relation to said ball joint positioned at one end of said main thigh-support frame;

a left guide arm freely pivotally connected to the left end of said main frame, said left guide arm adapted to extend upwardly from said main thigh-support frame along one side of a thigh positioned thereon;

a left retainer belt pivotally connected to the left end of said main thigh-support frame in operative engagement with said left guide arm, said left retainer belt adapted to extend upwardly along said left guide arm to a point therebeyond, said left retainer belt provided with a buckle-engaging tongue member, said tongue member selectively positioned approximately above a thigh positioned on said main thigh-support frame;

a right guide arm freely pivotally connected to the right end of said main thigh-support frame, said right guide arm adapted to extend upwardly from said main thigh-support frame in spaced-apart opposed registry with said left guide arm so as to bracket therebetween a thigh positioned on said main frame;

a right retainer belt pivotally connected to the right end of said main thigh-support frame in operative engagement with said right guide arm, said right retainer belt adapted to extend upwardly along said right guide arm to a point therebeyond, said right retainer belt adjustably provided with a snap-release latch buckle assembly in aligned operative registry with said tongue member, said buckle assembly adapted to selectively engage said tongue member so as to connect said left retainer belt and said right retainer belt around a thigh positioned on said main frame, said right retainer belt adapted for selective incremental tightening so as to cause said left retainer belt and said right retainer belt to exert selective retentive pressure against a thigh positioned on said main frame, said snap-release buckle assembly adapted to permit selective dis-engagement and selective re-engagement of said left retainer belt and said right retainer belt while maintaining the original selected retentive pressure of said belts against the thigh upon re-engagement without need for re-adjustment of said surgical leg clamp assembly.

2. In the surgical leg clamp of claim 1 wherein a foam cushion member is provided in association with said main thigh-support frame so as to selectively encompass a thigh positioned thereon.

3. In the surgical leg clamp of claim 1 wherein said universal ball-joint assembly is provided with a ball-joint member having a fixed ball-joint stem member extending downwardly therefrom to fixedly engage a horizontal crank adjustment bar, said crank adjustment bar provided with a fixed downwardly extending clamp post offset from said ball-joint stem member, said clamp post adapted for selective engagement with a standard post clamp assembly provided on an operating table, said horizontal crank adjustment bar being selectively rotatable in a horizontal plane in relation to said standard post clamp assembly so as to provide selective in and out transverse adjustment of said elongate main thigh-support frame in relation to the edge of an operating table upon which said main thigh-support frame is mounted.

* * * * *